United States Patent [19]

Lambert et al.

[11] 4,057,425

[45] Nov. 8, 1977

[54] 2-SUBSTITUTED BENZIMIDAZOLES IN MULTICOLOR DIFFUSION TRANSFER

[75] Inventors: Ronald F. Lambert, Wayland; Howard G. Rogers, Weston, both of Mass.

[73] Assignee: Polaroid Corporation, Cambridge, Mass.

[21] Appl. No.: 596,384

[22] Filed: July 16, 1975

[51] Int. Cl.[2] ..... G03C 7/00; G03C 1/40; G03C 1/76; G03C 5/30

[52] U.S. Cl. ..... 96/3; 96/29 D; 96/66.3; 96/73; 96/76 R; 96/77; 96/95; 96/109

[58] Field of Search ..... 96/3, 29 D, 77, 76 R, 96/95, 109, 66.3, 73

[56] References Cited

U.S. PATENT DOCUMENTS

| | | | |
|---|---|---|---|
| 2,939,789 | 6/1960 | Dersch et al. | 96/109 |
| 3,137,578 | 6/1964 | Selms | 96/109 |
| 3,265,498 | 8/1966 | Rogers et al. | 96/3 |
| 3,377,166 | 4/1968 | Weyerts et al. | 96/3 |
| 3,502,467 | 3/1970 | Becker | 96/3 |
| 3,575,699 | 4/1971 | Bloom et al. | 96/3 |
| 3,615,607 | 10/1971 | Soma | 96/109 |
| 3,667,957 | 6/1972 | Willems et al. | 96/109 |
| 3,756,821 | 9/1973 | Hayashi et al. | 96/95 |
| 3,782,936 | 1/1974 | Abbott et al. | 96/3 |
| 3,909,263 | 9/1975 | Yoshida et al. | 96/3 |

FOREIGN PATENT DOCUMENTS

| | | |
|---|---|---|
| 2,332,754 | 1/1974 | Germany. |

*Primary Examiner*—David Klein
*Assistant Examiner*—Richard L. Schilling
*Attorney, Agent, or Firm*—Stanley H. Mervis

[57] ABSTRACT

This application is concerned with dye developer diffusion transfer color processes and discloses the incorporation of certain 2-substituted benzimidazoles, e.g., 2-phenyl-benzimidazole, in a dye developer photosensitive element to provide improved temperature latitude.

26 Claims, No Drawings

2-SUBSTITUTED BENZIMIDAZOLES IN MULTICOLOR DIFFUSION TRANSFER

This invention is concerned with color photography and, more particularly, with photographic processes which provide dye developer diffusion transfer color images.

U.S. Pat. No. 2,983,606, issued May 9, 1961 to Howard G. Rogers, and numerous other patents disclose photographic processes employing dye developers and, in particular, the formation of diffusion transfer color images by the use of dye developers.

The present invention is concerned with the provision of improved temperature latitude in the performance of dye developer transfer processes.

The primary object of the present invention is to provide dye developer diffusion processes wherein improved temperature latitude is provided by performing said process employing a photosensitive element having a 2-substituted benzimidazole, e.g., 2-phenyl-benzimidazole, in a layer thereof.

A further object of this invention is to provide dye developer photosensitive elements containing a 2-substituted benzimidazole, e.g., 2-phenyl-benzimidazole, in a layer adjacent a silver halide emulsion layer.

Other objects of this invention will in part be obvious and will in part appear hereinafter.

The invention accordingly comprises the product possessing the features, properties and the relation of components and the process involving the several steps and the relation and order of one or more of such steps with respect to each of the others which are exemplified in the following detailed disclosure, and the scope of the application of which will be indicated in the claims.

This invention is particularly directed to photographic processes wherein the desired color transfer image is a multicolor image obtained by processing an exposed multicolor photosensitive silver halide element with a processing composition distributed between two sheet-like elements, one of said elements including an image-receiving layer. The processing composition is so applied and confined within and between the two sheet-like elements as not to contact or wet outer surfaces of the superposed elements, thus providing a film unit or film packet whose external surfaces are dry. The processing composition, which may be viscous or nonviscous, preferably is distributed in viscous form from a single-use rupturable container; such pressure rupturable processing containers are frequently referred to as "pods".

Multicolor diffusion transfer images may be obtained using dye developers by several techniques. A particularly useful technique employs an integral multilayer photosensitive element, such as is disclosed in the aforementioned U.S. Pat. No. 2,983,606, and particularly with reference to FIG. 9 thereof, and also in U.S. Pat. No. 3,345,163 issued Oct. 3, 1967 to Edwin H. Land and Howard G. Rogers, wherein at least two selectively sensitized photosensitive strata, superposed on a common support, are processed, simultaneously and without separation, with a single (common) image-receiving layer. A suitable arrangement of this type for obtaining multicolor images utilizing subtractive color principles comprises a support carrying a red-sensitive silver halide emulsion stratum, a green-sensitive silver halide emulsion stratum and a blue-sensitive silver halide emulsion stratum, said emulsions having associated therewih, respectively, a cyan dye developer, a magenta dye developer and a yellow dye developer. The dye developer may be positioned in the silver halide emulsion stratum, for example in the form of particles, or it may be disposed in a stratum behind the appropriate silver halide emulsion stratum with respect to the exposing light. Each set of silver halide emulsion and associated dye developer strata may be separated from other sets by suitable interlayers, for example, by a layer of stratum of gelatin, polyvinyl alcohol, or other polymeric materials known in the art. In certain instances, it may be desirable to incorporate a yellow filter in front of the green-sensitive emulsion to avoid improper exposure of said emulsion, by blue light, and such a yellow filter may be incorporated in the appropriately positioned interlayer. However, such a separate yellow filter may be omitted where a yellow dye developer of the appropriate spectral characteristics is present in a quantity and state capable of functioning as the requisite yellow filter. Procedures and suitable components for preparing such integral multicolor photosensitive elements are described in numerous patents and are well known in the art.

Following photoexposure, the photosensitive element is processed by application of a processing composition, for example, by immersion, coating, spraying, flowing, etc., in the dark. The exposed photosensitive element may be superposed prior to, during, or after application of the processing composition on a sheet-like element which may include an image-receiving layer. In one commercial embodiment, the processing composition is applied to the photosensitive element in a substantially uniform layer as the photosensitive element is brought into superposed relationship with the image-receiving layer. The liquid processing composition permeates the layers of the photosensitive element to initiate and effect development of the latent images contained therein. The dye developers are immobilized or precipitated imagewise in developed areas as a consequence of and in proportion to the silver halide development. This immobilization is, at least in part, due to a change in the solubility characteristics of the dye developers upon oxidation and especially as regards its solubility in alkaline solution. In undeveloped and partially developed areas of the silver halide emulsion layers, the respective unoxidized (unreacted) dye developers are diffusible. Development thus provides an imagewise distribution of unoxidized dye developer, diffusible in the alkaline processing composition, as a function of the point-to-point degree of exposure of a silver halide emulsion layer. At least part of each of these imagewise distributions of unoxidized dye developer is transferred, by imbibition, to a superposed image-receiving layer, said transfer substantially excluding oxidized dye developer. The image-receiving layer receives a depthwise diffusion, from each developed silver halide emulsion, of unoxidized dye developer without appreciably disturbing the imagewise distribution thereof to provide a reversed or positive color image of each developed silver image. The image-receiving layer may contain a mordant and/or other agent to immobilize the dye developer transferred thereto. If the color of a transferred dye developer is affected by changes in the pH of the image-receiving layer, this pH may be adjusted in accordance with well-known techniques to provide a pH affording the desired color. In the preferred embodiments of said U.S. Pat. No. 2,983,606 and in certain commercial applications thereof, the desired positive multicolor image is viewed by separating the image-receiving layer from the photosensitive element at the end of a suitable imbibition period.

In a more recent commercial application of the dye developer process, the image-receiving layer is not separated from its superposed relationship with the photosensitive layers subsequent to transfer image formation. Instead, the color image in the image-receiving layer is viewed through a transparent support. The aforementioned U.S. Pat. No. 2,983,606 discloses such an embodiment, the processing composition including a white pigment, such as titanium dioxide, in a quantity effective to mask or "hide" from view the developed silver halide emulsions now positioned behind the image-receiving layer when the image-receiving layer is viewed through the transparent support.

U.S. Pat. No. 3,415,644 issued Dec. 10, 1968 in the name of Edwin H. Land, discloses and claims photographic products and processes wherein a photosensitive element and an image-receiving element are maintained in fixed, superposed relationship prior to exposure, and this relationship is maintained as a laminate after processing and transfer image formation. The multicolor transfer image is viewed through a transparent (support) sheet against a reflecting, i.e., white, background. Photoexposure is made through said transparent support and the layers carried thereon, including the image-receiving layer, and application of the processing composition provides a layer of light-reflecting material to provide a white background. The light-reflecting material (referred to in said patent as an "opacifying agent") is preferably titanium dioxide but a number of other materials have been disclosed as useful. In addition to providing a masking layer so the transfer image may be viewed without interference by the images in the developed silver halide emulsions, the light-reflecting material also performs an opacifying function by reflecting ambient light passing through the image-receiving layer and its transparent support when the photoexposed film unit is removed from the camera before transfer image formation is completed, thereby acting to protect the photoexposed silver halide emulsions from post-exposure fogging by such light.

U.S. Pat. No. 3,647,437 issued Mar. 7, 1972 to Edwin H. Land is concerned with impovements in the above-mentioned processes, and discloses the provision of a light-absorbing material, sometimes referred to as an optical filter agent, to permit such processes to be performed outside of the camera in which photoexposure is effected and to be so performed under much more intense ambient light conditions. The light-absorbing material or optical filter agent, preferably a dye, is so positioned in the film unit and/or constituted as not to interfere with photoexposure (by absorbing light during photoexposure) but so positioned between the photoexposed silver halide emulsions and the transparent support during processing after photo-exposure as to absorb light which otherwise might fog the photoexposed emulsions. Furthermore, the light-absorbing material is so constituted and/or positioned after processing as not to interfere with viewing the desired image in its proper colors shortly after said image has been formed. In the preferred embodiments, the optical filter agent is a dye and is initially contained in the processing composition together with a light-reflecting material, e.g., titanium dioxide. The concentration of this light-absorbing dye is selected to provide the light transmission opacity required to perform the particular process under the selected light conditions, and a plurality of such dyes selected to together provide absorption over the visible spectrum is utilized in multicolor embodiments.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer. Suitable acid-reacting reagents, preferably polymeric acids, are disclosed in the aforementioned U.S. Pat. Nos. 3,415,644 and 3,647,437 to which reference may be made for more specific information.

Suitable materials for use as the image-receiving layer are disclosed in the aforementioned patents. Preferred image-receiving layers comprise polyvinyl alcohol or gelatin containing a dye mordant such as poly-4-vinylpyridine, as disclosed in U.S. Pat. No. 3,148,061, issued Sept. 8, 1964.

As disclosed in the previously cited patents, the liquid processing composition referred to for effecting multicolor diffusion transfer processes comprises at least an aqueous solution of an alkaline material, for example, sodium hydroxide, potassium hydroxide, and the like, and preferably possesses a pH in excess of 12, and most preferably includes a viscosity-increasing compound constituting a film-forming material of the type which, when the composition is spread and dried, forms a relatively firm and relatively stable film. Preferred film-forming materials comprise high molecular weight polymers such as polymeric, water-soluble ethers, for example, a hydroxyethyl cellulose or sodium carboxymethyl cellulose, which are substantially inert in alkaline solution. Other film-forming materials or thickening agents whose ability to increase viscosity is unimpaired if left in alkaline solution for extended periods of time also may be used. The film-forming material is preferably contained in the processing composition in such suitable quantities as to impart to the composition a viscosity appropriate for the particular method of application to be used, such viscosity being in excess of 100 cps. at a temperature of approximately 24° C. and preferably in the order of 100,000 cps. to 200,000 cps. at that temperature.

Dye developers are well known in the art and are compounds which contain both a silver halide developing function and the chromophoric system of a dye. By "a silver halide developing function" is meant a grouping adapted to develop exposed silver halide. The dye developer as incorporated in the photosensitive element may have a "latent" silver halide developing function, i.e., the dye developer may contain a moiety which is a precursor of the silver halide developing function or moiety, the active functional group being formed in situ following application of the processing /composition, e.g., by alkaline hydrolysis of an esterified hydroquinonyl group. A preferred silver halide developing function is a hydroquinonyl group. Other particularly useful developing functions include ortho-dihydroxyphenyl and ortho and para-amino substituted hydroxyphenyl groups. In general, the developing function includes a benzenoid silver halide developing function, that is, an aromatic silver halide developing group which forms quinonoid or quinone substances when oxidized. The dye developers usually are selected for their ability to provide colors useful in carrying out subtractive color photography, e.g., cyan, magenta and yellow. Other colors, of course, may be provided to meet the needs of a particular system.

For convenience, the disclosures of the above-mentioned U.S. Pat. Nos. 2,983,606, 3,415,644 and 3,647,437 are hereby incorporated herein, as is the disclosure of U.S. Pat. No. 3,801,318 issued Apr. 2, 1974 to Edwin H. Land, Stanley M. Bloom and Howard G. Rogers.

As noted above, the present invention is concerned with improving the temperature latitude of such dye developer diffusion transfer processes.

Conventional "wet process" photographic processes are designed to be performed at a specific temperature, and that temperature is intended to be controlled within very narrow limits, e.g., ± 0.5° F., to avoid major changes in the resulting sensitometry. Under such conditions, the photosensitive material and the processing solution(s) may be so designed that the optimum concentrations of the various chemicals to be utilized are provided in the photosensitive material and processing solution(s). Where it is necessary or desirable to deviate from the recommended processing temperature, it is sometimes possible to compensate by adding an appropriate additional quantity of a reagent, e.g., an antifoggant, when processing at a higher temperature.

Diffusion transfer film units, however, present different problems. It is desirable to be able to process such film units at ambient temperature, a temperature which may vary over a wide range, e.g., a range of 50° or 60° F., or even more, with a minimum variation in the sensitometric properties of the resulting images. The requisite reagents, however, are already incorporated in the film unit, and the user is not free to vary concentrations. This problem has been recognized, and several proposals have been made to provide improved latitude in processing temperature. Thus. U.S. Pat. No. 3,575,699 issued April 20, 1971 to Stanley M. Bloom and Howard G. Rogers teaches the use of antifoggant precursors which hydrolyze at a temperature dependent rate, with more antifoggant being released by hydrolysis of the antifoggant precursor at higher temperatures than at lower temperatures. U.S. Pat. No. 3,649,267 issued Mar. 14, 1972 to David P. Carlson and Jerome L. Reid discloses the use of metal complexed antifoggants which cleave in the alkaline processing composition to release antifoggant at a rate which increases with increases in temperature. Other systems which have been described for the purpose of releasing the antifoggant as a function of processing temperature include encapsulation. Common to all such techniques is the concept of "releasing" the particular reagent, the release rate varying with the temperature at which processing is effected.

In accordance with this invention, it has been found that certain 2-substituted benzimidazoles which exhibit only a low solubility in aqueous alkaline solution at room temperature, e.g., 75° F., and whose solubility in aqueous alkaline solution does not vary greatly with temperature, nevertheless impart improved temperature latitude to dye developer diffusion transfer processes if they are initially positioned within a layer of the photosensitive material, i.e., in a layer adjacent the silver halide emulsion or in the silver halide emulsion layer itself. Particularly useful 2-substituted benzimidazoles for providing improved temperature latitude are those substituted in the 2-position with a substituent containing at least 5 carbons, e.g.,

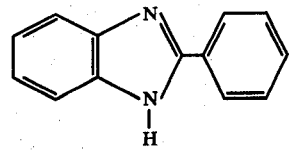

2-phenyl-benzimidazole

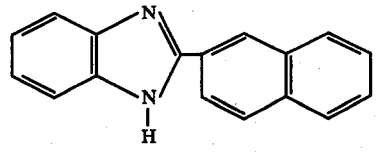

2-β-naphthyl-benzimidazole

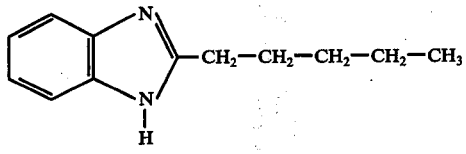

2-n-pentyl-benzimidazole

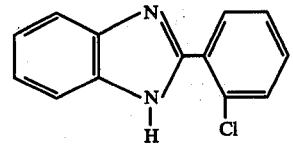

2-(2'-chlorophenyl)-benzimidazole

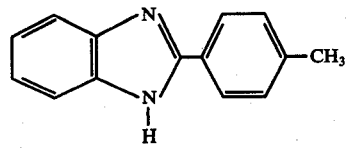

2-(p-tolyl)-benzimidazole

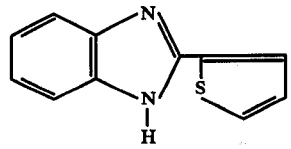

2-(2'-thienyl)-benzimidazole

In the preferred embodiments of this invention, the 2-substituted benzimidazole is initially positioned in the dye developer layer contiguous the silver halide emulsion layer. It is advantageous to position a quantity of the 2-substituted benzimidazole in each of the dye developer layers; this facilitates the provision for each silver halide emulsion of the quantity of the 2-substituted benzimidazole most appropriate for that silver halide emulsion, e.g., the silver coverage thereof, the tendency thereof towards fogging as a function of temperature, the development rate thereof as a function of temperature, etc. It is within the scope of this invention to employ different 2-substituted benzimidazoles with different silver halide emulsions, or a combination of different 2-substituted silver halide emulsions with a single silver halide emulsion.

In the preferred embodiments the 2-substituted benzimidazole is incorporated in the dye developer layer in the form of a solid dispersion; such solid dispersions may be prepared by following the techniques described in U.S. Pat. No. 3,438,775 issued Apr. 15, 1969 to Sidney Kasman and Howard G. Rogers.

It has been further found that the temperature latitude enhancement provided by the 2-substituted benzimidazoles may be increased by effecting processing in the presence of a reagent which further modifies the availability of the 2-substituted benzimidazole as a function of the temperature at which processing is effected. As an example of such a reagent mention may be made of N-phenethyl-α-picolinium bromide and N-benzyl-α-picolinium bromide.

As is well known in both conventional photography and diffusion transfer photography, it is customary to effect processing in the presence of one or more antifoggants, i.e., compounds which reduce or inhibit the development of unexposed silver halide; unexposed silver halide which otherwise might be developed would give rise to density not due to exposure by light and such "fog" density is frequently referred to as "chemical fog" or "heat fog". If the process is a color diffusion transfer process, this unwanted development results in an increase in film speed as well as a corresponding reduction in transfer image dye density, i.e., a lower $D_{max}$. Conversely, if an excess of antifoggant is present, development of exposed silver halide may be inhibited; in a color diffusion transfer process this failure to develop exposed silver halide results in a lowering of film speed as well as a corresponding increase in transfer image dye density, i.e., a higher $D_{min}$.

Such antifoggants usually have been included in the processing composition but it is also known to include an antifoggant in the photosensitive element itself. Such antifoggants generally have been readily soluble in aqueous alkaline solutions; thus, for example, the solubility of benzimidazole itself in pH 13.5 aqueous potassium hydroxide at 23° C. has been measured to be 4.3 grams/liter. In contrast, the 2-substituted benzimidazoles contemplated for use in the present invention are relatively insoluble; for example, the solubility of 2-phenyl-benzimidazole in pH 13.5 aqueous potassium hydroxide at 23° C. has been measured to be 0.12 gram/liter. This low solubility in alkali, combined with the usual decrease in solubility as the temperature is lowered, and the usual increase in solubility as the temperature is increased, is put to advantage in the present invention by initially positioning the 2-substituted benzimidazole in one or more layers of the photosensitive element. There is thus obtained the ability to essentially control the dissolved quantity of the 2-substituted benzimidazole in direct relation to the ambient temperature, i.e., a minimum, if any, at temperatures as low as 40°–45° F., and a maximum at temperatures of 95° F. or higher. The resulting substantially greater uniformity in film speed over such wide temperature ranges effectively minimizes "washed out" or desaturated images at high temperatures and "muddy" $D_{min}$. images at low temperatures.

In general it has been found unnecessary to include an antifoggant in the processing composition when a 2-substituted benzimidazole is incorporated in the photosensitive element. It will be understood, however, that in certain instances the incorporation of an antifoggant in small quantities in the processing composition may give a still more effective control of fog development as well as useful changes in the H and D curves of the several silver halide emulsions. In some instances, a small quantity of the same or a different 2-substituted benzimidazole advantageously may be added to the processing composition. Other antifoggants which have been found to provide advantageous sensitometric changes when added to the processing composition used to process a dye developer photosensitive element containing a 2-substituted benzimidazole include 6-alkylamino purines, e.g., 6-benzylamino purine, naphth[1,2d-]imidazole, benzotriazole and pyrazolopyrimidines, such as 4-amino-pyrazolo-[3,4d]pyrimidine.

This invention will be further illustrated by the following examples intended to be illustrative only.

EXAMPLE 1

A photosensitive element was prepared by coating a transparent polyethylene terephthalate support sequentially with a layer of the cyan dye developer

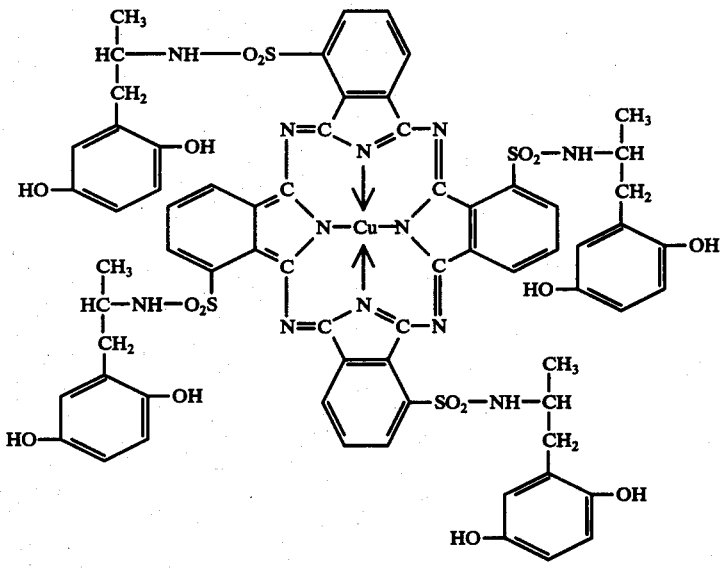

as a solid dispersion in gelatin at a coverage of about 50 mg./ft.$^2$ of the cyan dye developer and about 25 mg./ft.$^2$ of gelatin; a layer of about 25 mg./ft.$^2$ of polyvinyl pyrrolidone (GAF K-90) and about 20 mg./ft.$^2$ of 2-phenyl-benzimidazole (coated from ethanol solution); a layer of about 75 mg./ft.$^2$ of gelatin and about 100 mg./ft.$^2$ of silver of a red-sensitive silver iodobromide emulsion (5/8% iodide; such silver iodobromide emulsions are disclosed and claimed in the copending application of Edward G. Denk, Ser. No. 460,719 filed Apr. 15, 1974, and now abandoned; and an auxiliary layer containing about 30 mg./ft.$^2$ of gelatin and about 15 mg./ft.$^2$ of 4'-methylphenyl-hydroquinone.

A transparent 4 mil polyethylene terephthalate film base was coated, in succession, with the following layers to form an image-receiving component:

1. as a polymeric acid layer, a partial butyl ester of polyethylene/maleic anhydride copolymer at a coverage of about 2,500 mgs./ft.$^2$;
2. a timing layer containing about a 40:1 ratio of a 60–30–4–6 copolymer of butyl acrylate, diacetone acrylamide, styrene and methacrylic acid and polyacrylamide at a coverage of about 500 mgs./ft.$^2$; and
3. a polymeric image-receiving layer containing a 2:1 mixture, by weight, of polyvinyl alcohol and poly-4-vinylpyridine, at a coverage of about 300 mgs./ft.$^2$ The photosensitive element was exposed to a step wedge and then taped to the image-receiving component with a rupturable container retaining an aqueous alkaline processing solution fixedly mounted on the leading edge, by pressure-sensitive tapes, so that, upon application of compressive pressure to the container to rupture the container's marginal seal, its contents would be distributed between the image-receiving layer and the gelatin overcoat layer of the photosensitive component in a layer approximately 0.0026 inch thick. The aqueous alkaline processing composition comprised:

| | | |
|---|---|---|
| Potassium hydroxide | 4.51 | g. |
| N-benzyl-α-picolinium bromide | 0.62 | g. |
| N-phenethyl-α-picolinium bromide | 0.38 | g. |
| Sodium carboxymethyl cellulose (Hercules Type 7H4F providing a viscosity of 3,000 cps. at 1% in water at 25° C.) | 1.04 | g. |
| Titanium dioxide | 42.7 | g. |
| Lithium nitrate | 0.1 | g. |
| Benzotriazole | 0.28 | g. |
| Colloidal silica ($SiO_2$) | 0.74 | g. |
| N-2-hydroxyethyl-N,N',N'-tris-carboxymethyl-ethylene diamine | 0.83 | g. |
| Lithium hydroxide | 0.1 | g. |
| Polyethylene glycol (molecular weight 6,000) | 0.54 | g. |
| 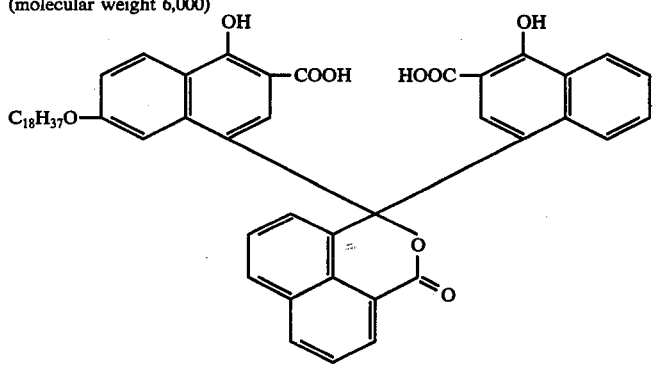 | 2.7 | g. |
| 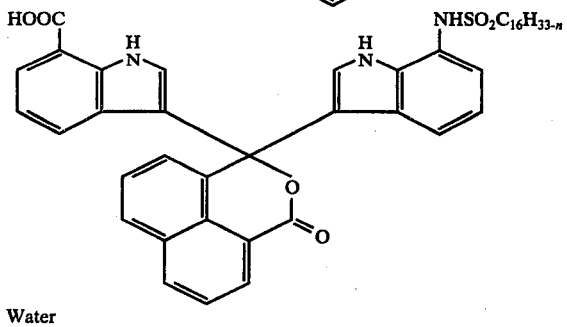 | 0.6 | g. |
| Water | 45.23 | g. |

The resulting laminate was maintained intact to provide a cyan integral negative-positive reflection print.

The just described procedure was performed at 40°, 75° and 100° F. It was found that the film speed over this temperature range varied much less than did the film speed of a control photosensitive element which did not include the 2-phenyl-benzimidazole but otherwise having the same composition (including the polyvinylpyrrolidone).

EXAMPLE 2

The procedure described in Example 1 was repeated using 2-(2'-chlorophenyl)-benzimidazole, 2-(β-naphthyl)-benzimidazole, 2-pentyl-benzimidazole and 2-(2'-thienyl)-benzimidazole, respectively. In each instance, the film speed over the temperature range varied much less than the control. In contrast, use of 2-ethyl-benzimidazole, 2-methyl-benzimidazole or 2-propyl-benzimidazole (each of which are much more soluble in aqueous alkali) in the same manner did not show the desired improvement in temperature latitude.

EXAMPLE 3

A photosensitive element was prepared by coating a transparent polyethylene terephthalate film base with a layer (approximately 100 mg./ft.$^2$ of the cyan dye developer solid dispersion of Example 1; the red-sensitive silver iodobromide emulsion of Example 1 (approximately 100 mg./ft.$^2$ of silver halide as silver) also containing 5 mg./ft.$^2$ of a solid dispersion of 2-phenyl-benzimidazole; and an auxiliary layer containing approximately 30 mg./ft.$^2$ of gelatin and 15 mg./ft.$^2$ of 4'-methylphenyl-hydroquinone. This photosensitive element was exposed on a sensitometer and then processed in the same manner as in Example 1 using the following processing composition:

| | |
|---|---|
| Potassium hydroxide | 4.82 g. |
| Sodium carboxymethyl cellulose (Hercules Type 7H4F providing a viscosity of 3,000 cps. at 1% in water at 25° C.) | 1.03 g. |
| Titanium dioxide | 42.8 g. |
| 6-methyl uracil | 0.3 g. |
| bis-(β-aminoethyl)-sulfide | 0.21 g. |
| Lithium nitrate | 0.1 g. |
| Benzotriazole | 0.57 g. |
| Colloidal silica | 0.55 g. |
| N-2-hydroxyethyl-N,N',N'-tris-carboxymethyl-ethylene diamine | 0.85 g. |
| Lithium hydroxide | 0.11 g. |
| Polyethylene glycol (molecular weight 6,000) | 0.55 g. |
| 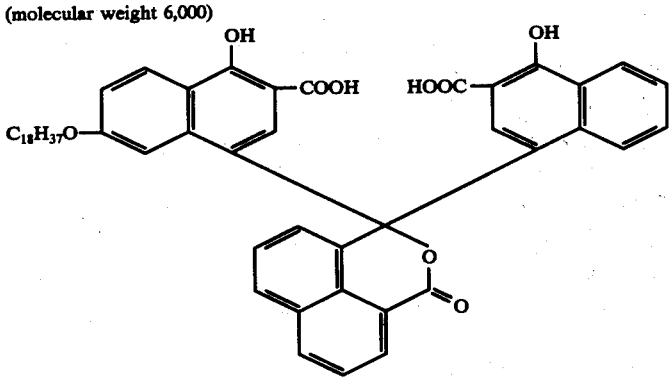 | 2.68 g. |
| 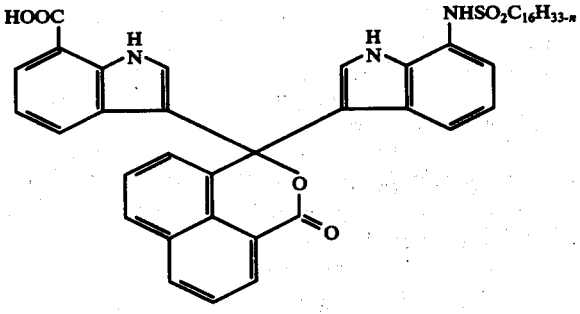 | 0.6 g. |
| Water | 44.75 g. |

EXAMPLE 4

A photosensitive element was prepared by coating an opaque polyethylene terephthalate film base with the following layers in succession:

1. a layer containing the cyan dye developer of Example 1 dispersed in gelatin and coated at a coverage of about 110 mg./ft.$^2$ of dye, about 98 mg./ft.$^2$ of gelatin and 17 mg./ft.$^2$ of 4'-methylphenyl hydroquinone; and about 46 mg./ft.$^2$ of 2-phenyl-benzimidazole;
2. a red-sensitive gelatino silver iodobromide emulsion layer having a 0.625 mole percent iodide content and coated at a coverage of about 140 mg./ft.$^2$ of silver and about 61 mg./ft.$^2$ of gelatin;
3. an interlayer of a 60/30/4/6 tetrapolymer butyl acrylate, diacetone acrylamide, styrene and methacrylic acid, plus about 2.4% by weight of polyacrylamide permeator, coated at about 290 mg./ft.$^2$ of total solids;
4. a layer comprising the magenta dye developer:

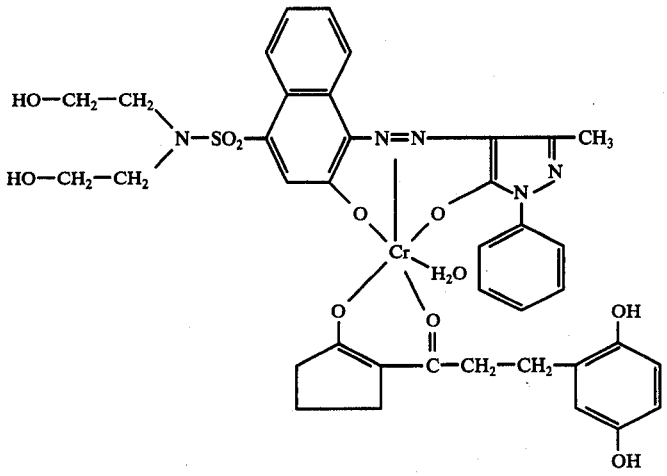

dispersed in gelatin and coated at a coverage of about 67.5 mg./ft.$^2$ of dye and about 66 mg./ft.$^2$ of gelatin; and about 20 mg./ft.$^2$ of 2-phenyl-benzimidazole;

5. a green-sensitive gelatino silver iodobromide emulsion layer having a 0.625 mole percent iodide content and coated at a coverage of about 72 mg./ft.$^2$ of silver and about 85 mg./ft.$^2$ of gelatin;
6. a layer containing the tetrapolymer referred to above in layer 3 plus about 7.8% polyacrylamide coated at about 107 mg./ft.$^2$ of total solids; and also containing succindialdehyde at about 9.8 mg./ft.$^2$;
7. a layer comprising the yellow dye developer:

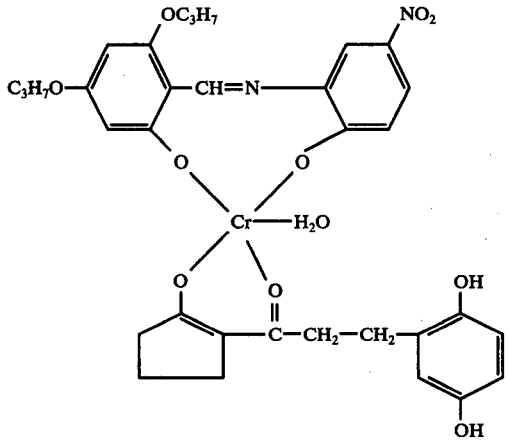

dispersed in gelatin and coated at a coverage of about 75 mg./ft.$^2$ of dye and about 58 mg./ft.$^2$ of gelatin; and about 30 mg./ft.$^2$ of 2-phenyl-benzimidazole;

8. a blue-sensitive gelatino silver iodobromide emulsion having a 0.625 mole percent iodide content and coated at a coverage of about 92 mg./ft.$^2$ of silver and about 53 mg./ft.$^2$ of gelatin, plus about 25 mg./ft.$^2$ of 4'-methylphenylhydroquinone and 34 mg./ft.$^2$ of gelatin;
9. a gelatin overcoat layer coated at a coverage of about 30 mg./ft.$^2$ of gelatin.

An image-receiving element was prepared by coating the following layers on a cellulose acetate butyrate subcoated baryta paper support:

1. a mixture of about 8 parts, by weight, of a partial butyl ester of polyethylene/maleic anhydride and about 1 part, by weight, of polyvinyl butyral to form a polymeric acid layer approximately 0.8 mils thick; (about 2,000 mg./ft.$^2$);
2. a mixture of about 7 parts, by weight, of hydroxypropyl cellulose (Klucel J12HB, Hercules, Inc., Wilmington, Delaware), and about 4 parts, by weight, of polyvinyl alcohol; to form a spacer layer approximately 0.25 mils thick (about 600 mg./ft.$^2$); and
3. a mixture of about 2 parts of polyvinyl alcohol and 1 part of poly-4-vinylpyridine to form an image-receiving layer approximately 0.35 mils thick (about 800 mg./ft.$^2$), and hardened by a condensate of acrolein and formaldehyde.
4. a 3:2 mixture by weight of ammonium hydroxide and gun arabic coated at a coverage of about 25 mg./ft.$^2$ of total solids.

The photosensitive element was exposed and processed by spreading the following processing composition in a layer approximately 0.0044 inch thick between said elements as they were brought into superposed relationship:

| | | |
|---|---|---|
| Potassium hydroxide | 7.82 | g. |
| Benzotriazole | 0.87 | g. |
| 6-methyl uracil | 0.7 | g. |
| zinc nitrate (anhydrous) | 0.3 | g. |
| phenethyl-α-picolinium bromide | 1.65 | g. |
| Sodium carboxymethyl hydroxyethyl cellulose (high viscosity) | 2.60 | g. |
| Titanium dioxide | 0.44 | g. |
| Potassium thiosulfate | 0.084 | g. |
| Water | 85.15 | g. |

After an imbibition period of approximately 1 minute at 70° F., the superposed elements were separated to reveal a multicolor diffusion transfer image. This process was repeated at 40° F. (3 minutes imbibition), 55° (2 minutes imbibition), 95° and 100° F. In each instance the red, green and blue speeds of the multicolor transfer image showed markedly less difference over this temperature range than in a control omitting the 2-phenyl-benzimidazole.

EXAMPLE 5

A photosensitive element was prepared by coating an opaque polyethylene terephthalate with 1. the cyan dye developer of Example 1 dispersed in gelatin and coated at a coverage of about 48 mg./ft.$^2$ of dye, about 92 mg./ft.$^2$ of gelatin, and about 20 mg./ft.$^2$ of 2-phenyl-benzimidazole;

2. a red-sensitive gelatino silver iodobromide emulsion layer having a 0.625 mole percent iodide content and coated at a coverage of about 95 mg./ft.$^2$ of silver and about 27 mg./ft.$^2$ of gelatin;

3. an interlayer of a 60/30/4/6 tetrapolymer of butyl acrylate, diacetone acrylamide, styrene and methacrylic acid, plus about 2.4% by weight of polyacrylamide permeator, coated at about 264 mg./ft.$^2$ of total solids;

4. a layer comprising the magenta dye developer of Example 4 dispersed in gelatin and coated at a coverage of about 62 mg./ft.$^2$ of dye and about 50 mg./ft.$^2$ of gelatin; and about 10 mg./ft.$^2$ of 2-phenyl-benzimidazole;

5. a green-sensitive gelatino silver iodobromide emulsion layer having a 0.625 mole percent iodide content and coated at a coverage of about 70 mg./ft.$^2$ of silver and about 40 mg./ft.$^2$ of gelatin;

6. a layer containing the tetrapolymer referred to above in layer 3 plus about 7.8% polyacrylamide coated at about 60 mg./ft.$^2$ of total solids; and also containing succindialdehyde at about 10 mg./ft.$^2$;

7. a layer comprising the yellow dye developer of Example 4 dispersed in gelatin and coated at a coverage of about 100 mg./ft.$^2$ of dye and about 54 mg./ft.$^2$ of gelatin; about 15 mg./ft.$^2$ of 4'-methylphenyl hydroquinone, and about 20 mg./ft.$^2$ of 2-phenyl-benzimidazole;

8. a blue-sensitive gelatino silver iodobromide emulsion having a 0.625 mole percent iodide content and coated at a coverage of about 125 mg./ft.$^2$ of silver and about 33 mg./ft.$^2$ of gelatin, plus about 37 mg./ft.$^2$ of 4'-methylphenylhydroquinone;

9. a layer of gelatin coated at a coverage of about 40 mg./ft.$^2$

This photosensitve element was exposed and processed in the manner described in Example 1. Again it was found that improved temperature latitude, i.e., less variation in the red, green and blue speeds as a function of temperature, was obtained over the temperature range of 40°–100° F. than was found with the same film absent the 2-phenyl-benzimidazole.

The above examples demonstrate the ability of the 2-substituted benzimidazoles to provide highly desirable increased temperature latitude in dye developer diffusion transfer films. While the 2-substituted benzimidazoles may be incorporated in the desired layer of the photosensitive element as a molecular dispersion (i.e., from organic solution in a suitable polymeric binder) or as a so-called oil dispersion, the most useful results have been obtained when the 2-phenyl-benzimidazole was incorporated as a solid dispersion as was used in Examples 3, 4 and 5.

It will be recognized by those skilled in the art that while the quantity of a given 2-substituted benzimidazole which will be most effective in providing increased temperature latitude will vary with the particular silver halide emulsion, dye developer and other processing conditions, useful concentrations may be readily determined by routine scoping experiments.

It is recognized that numerous 2-substituted benzimidazoles have been described in the photographic literature as having antifoggant activity. See, for example, U.S. Pat. No. 3,137,578 issued June 16, 1964 and German Offenlegungsschrift 2,332,754 published Jan. 17, 1974. The photographic art, however, has not recognized the unique difference between the various 2-substituted benzimidazoles which the present invention utilizes nor has it suggested that highly improved temperature latitude could be obtained by incorporating into a dye developer photosensitive element a 2-substituted benzimidazole having very low solubility in aqueous alkaline solution.

As noted above, development is advantageously effected in the presence of an onium compound, particularly a quaternary ammonium compound, in accordance with the processes disclosed in U.S. Pat. No. 3,173,786 issued Mar. 16, 1965 to Milton Green and Howard G. Rogers. Quaternary ammonium compounds which form an active methylene compound in alkali are especially useful.

Development may be effected in the presence of a colorless auxiliary or accelerating developing agent, such as a 3-pyrazolidone or a hydroquinone, such as 4'-methylphenylhydroquinone, which may be initially positioned in a layer of the photosensitive element or in the processing composition, in accordance with known techniques.

The image-receiving element may be prepared according to the disclosure of U.S. Pat. No. 3,362,819 issued January 9, 1968 to Edwin H. Land and U.S. Pat. No. 3,455,686 issued July 15, 1968 to Leonard C. Farney, Howard G. Rogers and Richard W. Young.

Since certain changes may be made in the above product and process without departing from the scope of the invention herein involved, it is intended that all matter contained in the above description shall be interpreted as illustrative and not in a limiting sense.

What is claimed is:

1. A diffusion transfer color process comprising exposing a photosensitive element comprising a blue-sensitive silver halide emulsion having a yellow dye developer associated therewith, a greensensitive silver halide emulsion having a magenta dye developer associated therewith, and a red-sensitive silver halide emulsion having a cyan dye developer associated therewith, applying an aqueous alkaline processing composition to said exposed photosensitive element to effect development and to form an imagewise distribution of unoxidized dye developer in undeveloped areas of each of said silver halide emulsions as a function of said development, said process including the step of transferring by diffusion at least a portion of said imagewise distributions of unoxidized dye developer to an image-receiving layer in superposed relationship therewith to thereby provide a multicolor diffusion transfer image, at least one of said silver halide emulsions having associated therewith in the same layer or in an adjacent layer a 2-substituted benzimidazole selected from the group consisting of 2-phenyl-benzimidazole, 2-$\beta$-naphthyl-benzimidazole, 2-p-tolyl-benzimidazole, 2-(2'-chlorophenyl)-benzimidazole and 2-(2'-thienyl)-benzimidazole, said 2-substituted benzimidazole being present in a quantity effective to provide improved temperature latitude.

2. A diffusion transfer process as defined in claim 1 wherein said 2-substituted benzimidazole is a 2-phenyl-benzimidazole.

3. A diffusion transfer process as defined in claim 1 wherein said 2-substituted benzimidazole is 2-$\beta$-naphthyl-benzimidazole.

4. A diffusion transfer process as defined in claim 1 wherein said 2-substituted benzimidazole is 2-(2'-thienyl)-benzimidazole.

5. A diffusion transfer color process as defined in claim 1 wherein a layer combining titanium dioxide is positioned between said image-receiving layer and said silver halide emulsions whereby said transfer image may be viewed without separating said image-receiving layer from said silver halide emulsions.

6. A diffusiion transfer color process as defined in claim 5 wherein titanium dioxide is initially present in said aqueous alkaline processing composition.

7. A photographic product for use in forming a diffusion transfer image in color comprising a photosensitive element comprising a support carrying a blue-sensitive silver halide emulsion having a yellow dye developer associated therewith, a green-sensitive silver halide emulsion having a magenta dye developer associated therewith, and a red-sensitive silver halide emulsion having a cyan dye developer associated therewith; a second, sheet-like element positioned in superposed or superposable relationship with said photosensitive element; an image-receiving layer positioned in one of said elements; a rupturable container releasably holding an aqueous alkaline processing composition adapted, when distributed between a pair of predetermined layers carried by said photosensitive element and said second element, to develop said silver halide emulsions and provide a diffusion transfer image in color on said image-receiving layer; at least one of said silver halide emulsions having associated therewith in the same layer or in an adjacent layer a 2-substituted benzimidazole selected from the group consisting of 2-phenyl-benzimidazole, 2-β-naphthyl-benzimidazole, 2-p-tolyl-benzimidazole, 2-(2'-chlorophenyl)-benzimidazole and 2-(2'-thienyl)-benzimidazole, said 2-substituted benzimidazole being present in a quantity effective to provide improved temperature latitude.

8. A photographic product as defined in claim 7 wherein said second element includes said image-receiving layer carried by a transparent support, and said aqueous alkaline processing composition includes titanium dioxide.

9. A photographic product as defined in claim 7 wherein said 2-substituted benzimidazole is 2-phenylbenzimidazole.

10. A photographic product as defined in claim 7 wherein said 2-substituted benzimidazole is 2-β-naphthylbenzimidazole.

11. A photographic product as defined in claim 7 wherein said 2-substituted benzimidazole is 2-(2'-thienyl)-benzimidazole.

12. A photographic product as defined in claim 7 wherein said 2-substituted benzimidazole is positioned in said red sensitive silver halide emulsion.

13. A photographic product as defined in claim 7 wherein said 2-substituted benzimidazole is positioned in said cyan dye developer containing layer.

14. A photographic product as defined in claim 7 wherein each of said silver halide emulsions has a said 2-substituted benzimidazole associated therewith.

15. A photographic product as defined in claim 7 wherein said aqueous alkaline processing composition includes a quaternary ammonium salt.

16. A photographic product as defined in claim 7 wherein each said 2-substituted benzimidazole is present in the form of a solid dispersion.

17. A photographic product as defined in claim 7 wherein at least one of said silver halide emulsions is a silver iodobromide emulsion containing about 5/8 mole percent iodide.

18. A photographic product as defined in claim 7 wherein each said silver halide emulsion is a silver iodobromide emulsion containing about 5/8 mole percent iodide.

19. A photographic product for use in forming a diffusion transfer image in color comprising a photosensitive element comprising a support carrying at least one light-sensitive silver halide emulsion, each said silver halide emulsion having a dye developer associated therewith; at least one said silver halide emulsion(s) having associated therewith in the same layer or in an adjacent layer a 2-substituted benzimidazole selected from the group consisting of 2-substituted benzimidazole selected from the group consisting of 2-phenyl-benzimidazole, 2-β-naphthyl-benzimidazole, 2-p-tolyl-benzimidazole, 2-(2'-chlorophenyl)-benzimidazole and 2-(2'-thienyl)-benzimidazole, said 2-substituted benzimidazole being present in a quantity effective to provide improved temperature latitude.

20. A photographic product as defined in claim 19 wherein said 2-substituted benzimidazole is 2-phenylbenzimidazole.

21. A photographic product as defined in claim 19 wherein said 2-substituted benzimidazole is 2-β-naphthylbenzimidazole.

22. A photographic product as defined in claim 19 wherein said 2-substituted benzimidazole is 2-(2'-thienyl)-benzimidazole.

23. A photographic product as defined in claim 19 wherein said 2-substituted benzimidazole is positioned in a least one said silver halide emulsion.

24. A photographic product as defined in claim 19 wherein said 2-substituted benzimidazole is positioned in at least one said dye developer containing layer.

25. A photographic product as defined in claim 19 wherein said silver halide emulsions are a red-sensitive silver halide emulsion having associated therewith a cyan dye developer, a green-sensitive silver halide emulsion having associated therewith a magenta dye developer, and a blue-sensitive silver halide emulsion having associated therewith a yellow dye developer.

26. A photographic product as defined in claim 25 wherein at least one of said silver halide emulsions is a silver iodobromide emulsion containing about $\frac{5}{8}$ mole percent iodide.

* * * * *